US010016001B2

(12) United States Patent
Waters et al.

(10) Patent No.: US 10,016,001 B2
(45) Date of Patent: Jul. 10, 2018

(54) BREATHABLE GARMENT AND METHOD OF USE

(71) Applicant: BreathableBaby, LLC, Minnetonka, MN (US)

(72) Inventors: Dale Richard Waters, Eagan, MN (US); Susan Marie Waters, Eagan, MN (US)

(73) Assignee: Breathable Baby, LLC, Minnetonka, MN (US)

( * ) Notice: Subject to any disclaimer, the term of this patent is extended or adjusted under 35 U.S.C. 154(b) by 665 days.

(21) Appl. No.: 14/451,914

(22) Filed: Aug. 5, 2014

(65) Prior Publication Data

US 2014/0338402 A1 Nov. 20, 2014

Related U.S. Application Data

(63) Continuation of application No. 12/755,547, filed on Apr. 7, 2010, now Pat. No. 8,793,813, which is a (Continued)

(51) Int. Cl.
*A41D 11/00* (2006.01)
*A41D 27/28* (2006.01)

(Continued)

(52) U.S. Cl.
CPC ..... *A41D 11/00* (2013.01); *A41B 13/06* (2013.01); *A41D 27/28* (2013.01); *A41D 31/02* (2013.01);

(Continued)

(58) Field of Classification Search
CPC ..... A47G 9/02; A47G 9/0207; A47G 9/0223; A47G 9/0238; A47G 9/06; A47G 9/062;

(Continued)

(56) References Cited

U.S. PATENT DOCUMENTS 1,056,712 A 3/1913 Schweda
2,128,978 A 9/1938 Akin (Continued)

FOREIGN PATENT DOCUMENTS

DE 10 2006 024855 12/2007
FR 2 867 045 9/2005

(Continued)

OTHER PUBLICATIONS

"Safe-N-Secure Crib Liner" datasheet [online]. Tender Creations, Inc., Southampton, MN, [retrieved on Feb. 4, 2000]. Retrieved from the Internet:<URL:http://www.tendercreations.com/cribliner.htm>; 8 pgs.

(Continued)

*Primary Examiner* — Robert G Santos
(74) *Attorney, Agent, or Firm* — Cozen O'Connor

(57) ABSTRACT

A garment includes a front side and a back side. The front side and back side are coupled to surround at least part of a person's body. The front side includes a mesh outer shell and a lightweight inner mesh liner, and the inner mesh liner includes a material that provides moisture wicking. The back side includes a breathable material that substantially maintains three-dimensional breathability when the person rests upon it. The garment provides breathability substantially surrounding said at least part of the person's body.

20 Claims, 6 Drawing Sheets

Related U.S. Application Data continuation-in-part of application No. 11/446,017, filed on Jun. 2, 2006, now Pat. No. 7,523,513, which is a continuation of application No. 10/738,616, filed on Dec. 16, 2003, now Pat. No. 7,055,192.

(60) Provisional application No. 60/434,324, filed on Dec. 17, 2002.

(51) Int. Cl.

| | |
|---|---|
| ***A41B 13/06*** | (2006.01) |
| ***A47G 9/08*** | (2006.01) |
| ***A41D 31/02*** | (2006.01) |
| *A41D 13/002* | (2006.01) |

(52) U.S. Cl.

CPC ..... *A47G 9/083* (2013.01); *A41D 13/002* (2013.01); *A41D 2400/20* (2013.01); *A41D 2400/22* (2013.01); *A41D 2400/60* (2013.01)

(58) Field of Classification Search

CPC ..... A47G 9/064; A47G 9/066; A47G 9/08; A47G 9/083; A47G 9/086; A47B 13/06; A47B 13/065; A41B 13/06; A41B 13/065; A41D 11/00; A41D 27/28; A41D 2400/20; A41D 2400/22

USPC ..... 5/494, 482, 502, 413 R, 417, 420; 2/69, 2/69.5, 4

See application file for complete search history.

(56) References Cited

U.S. PATENT DOCUMENTS 2,566,790 A 9/1951 Bloomfield
2,727,242 A 2/1954 Pascal
2,784,420 A 3/1957 Moltane
2,808,596 A 10/1957 Schreiner
2,927,331 A 3/1960 Ruiz
3,103,669 A 9/1963 Mundis
3,183,527 A 5/1965 Turner
3,199,123 A 8/1965 Komiske
3,325,832 A 6/1967 Malicki
3,438,069 A 4/1969 Long
3,619,824 A 11/1971 Doyle
3,877,090 A 4/1975 Schutz
3,882,871 A 5/1975 Taniguchi
4,232,415 A 11/1980 Webber
4,280,342 A 7/1981 Eng et al.
4,370,765 A 2/1983 Webber
4,526,830 A 7/1985 Ferziger et al.
4,569,874 A * 2/1986 Kuznetz ..... A41D 31/0038 2/272
4,579,753 A 4/1986 Gjendemsjo
4,644,591 A 2/1987 Goldberg
4,670,923 A 6/1987 Gabriel et al.
4,716,594 A * 1/1988 Shannon ..... A41D 13/001 2/4
4,724,558 A 2/1988 Reiff
4,750,225 A 6/1988 Simons et al.
4,767,419 A 8/1988 Fattore
4,864,669 A 9/1989 Jones
4,890,346 A 1/1990 Rist
4,914,772 A 4/1990 Difloe
4,922,565 A 5/1990 Blake
5,010,611 A 4/1991 Mallett
5,027,457 A 7/1991 Sweet
5,086,530 A 2/1992 Blake
5,093,947 A 3/1992 Henegar et al.
5,111,544 A 5/1992 Graebe
5,241,718 A 9/1993 Pope
5,383,236 A * 1/1995 Sesselmann ..... A41D 13/00 2/1
5,385,036 A 1/1995 Spillane et al.
5,410,765 A 5/1995 Youngblood
5,421,046 A 6/1995 Vande Streek
5,509,157 A 4/1996 Story
5,515,559 A 5/1996 Benson
5,517,707 A 5/1996 LaMantia
5,539,930 A * 7/1996 Sesselmann ..... A41D 13/00 2/243.1
5,566,407 A 10/1996 Lien
5,575,025 A 11/1996 Peters
5,577,276 A 11/1996 Nicholson et al.
5,600,850 A * 2/1997 Shannon ..... A41D 13/001 2/4
5,642,545 A 7/1997 Howard
5,699,571 A 12/1997 Yowell
5,706,534 A 1/1998 Sherman
5,787,534 A 8/1998 Hargest et al.
5,790,987 A * 8/1998 Sesselmann ..... A41D 13/00 2/243.1
5,806,112 A 9/1998 Harms
5,855,031 A 1/1999 Swift, Jr.
5,857,232 A 1/1999 Mahdavi
5,870,785 A 2/1999 Hoorens
5,881,408 A 3/1999 Bashista et al.
5,897,164 A 4/1999 Kagan et al.
5,933,885 A 8/1999 Glassford
5,937,458 A 8/1999 DeRosa
5,950,264 A 9/1999 Wyner et al.
6,009,559 A * 1/2000 Sesselmann ..... A41D 13/00 2/243.1
6,012,189 A 1/2000 Dudley
6,017,601 A 1/2000 Keller et al.
6,019,421 A 2/2000 Roh
6,039,393 A 3/2000 Roh
6,055,690 A 5/2000 Koenig
6,079,980 A 6/2000 Durand
6,089,947 A 7/2000 Green
6,134,718 A * 10/2000 Sesselmann ..... A41D 13/00 2/1
D433,851 S 11/2000 Roh
6,168,495 B1 1/2001 Yoon
6,170,101 B1 1/2001 McCloud
6,174,584 B1 1/2001 Keller et al.
6,178,573 B1 1/2001 Wagner et al.
6,243,895 B1 6/2001 Amin
D444,329 S 7/2001 Newman
6,256,813 B1 7/2001 Aaron
6,263,529 B1 7/2001 Chadwick et al.
6,305,487 B1 10/2001 Fujita et al.
6,315,364 B1 11/2001 Fujita et al.
6,347,422 B2 2/2002 Heavrin
6,421,857 B2 7/2002 Whatman et al.
6,438,775 B1 8/2002 Koenig
6,489,000 B1 12/2002 Ogura et al.
6,550,033 B1 4/2003 LaMantia
6,564,403 B1 5/2003 Titus
6,618,880 B1 9/2003 Chase
6,670,018 B2 12/2003 Fujita et al.
6,681,421 B2 1/2004 Carroll
6,684,437 B2 2/2004 Koenig
6,718,577 B2 4/2004 Li
6,718,578 B2 4/2004 Li
6,754,919 B2 6/2004 Leaphart
6,772,457 B1 8/2004 Alaback
6,859,958 B2 3/2005 LaMantia
6,859,962 B2 3/2005 Diak/Ghanem
6,910,896 B1 6/2005 Owens et al.
6,934,985 B2 8/2005 Sanders
D510,217 S 10/2005 Neveau
6,957,464 B1 10/2005 Coauette
6,971,130 B2 12/2005 Chase
7,003,823 B1 2/2006 Reed et al.
7,007,325 B1 3/2006 Gomeh
7,055,192 B2 6/2006 Waters et al.
7,107,638 B2 9/2006 Wilson
7,181,797 B2 2/2007 Chase
D584,555 S 1/2009 Estee
7,523,513 B2 4/2009 Waters et al.
7,694,364 B1 4/2010 Toma
7,743,442 B2 6/2010 Maloney et al.
7,793,368 B2 9/2010 Burrell, IV

(56) References Cited

U.S. PATENT DOCUMENTS

| | | | | |
|---|---|---|---|---|
| 7,887,387 | B2 | 2/2011 | Colvin | |
| 8,069,496 | B2 | 12/2011 | Sesselmann | |
| 8,161,584 | B1 | 4/2012 | Del Rio | |
| 8,220,088 | B2 | 7/2012 | Waters et al. | |
| 8,321,980 | B2 | 12/2012 | Maloney | |
| 8,365,323 | B2 | 2/2013 | Crumrine | |
| 8,434,179 | B2 | 5/2013 | Reeves et al. | |
| 8,539,626 | B2 | 9/2013 | Dunne et al. | |
| 8,590,081 | B1 | 11/2013 | Dunne et al. | |
| 8,646,128 | B2 | 2/2014 | Kaplan et al. | |
| 8,661,581 | B2 | 3/2014 | Kaplan et al. | |
| 8,689,379 | B2 | 4/2014 | Cicci | |
| 8,713,734 | B2 | 5/2014 | Davis | |
| 8,793,813 | B2 | 8/2014 | Waters et al. | |
| 8,887,332 | B2 | 11/2014 | Alletto | |
| 8,959,683 | B2 | 2/2015 | Rochlin | |
| 9,015,883 | B2 | 4/2015 | Alletto | |
| D728,199 | S * | 5/2015 | Barski | D2/719 |
| 9,038,222 | B2 | 5/2015 | Cicci | |
| 2001/0000362 | A1 | 4/2001 | Wagner et al. | |
| 2001/0037526 | A1 | 11/2001 | Whatman et al. | |
| 2002/0004114 | A1 | 1/2002 | Leaphart | |
| 2002/0026669 | A1 | 3/2002 | Carroll | |
| 2002/0034901 | A1 | 3/2002 | Fujita et al. | |
| 2002/0178500 | A1 | 12/2002 | Koenig | |
| 2003/0028964 | A1 | 2/2003 | Li | |
| 2003/0177576 | A1 | 9/2003 | LaMantia | |
| 2003/0224691 | A1 | 12/2003 | Carey | |
| 2004/0049850 | A1 | 3/2004 | Li | |
| 2004/0088790 | A1 | 5/2004 | Chase | |
| 2004/0107474 | A1* | 6/2004 | Sesselmann | A41D 13/00 2/69 |
| 2004/0128764 | A1 | 7/2004 | McGrath et al. | |
| 2004/0154099 | A1 | 8/2004 | Waters et al. | |
| 2004/0199999 | A1 | 10/2004 | Landry | |
| 2004/0231055 | A1 | 11/2004 | Sanders | |
| 2005/0039262 | A1 | 2/2005 | Chase | |
| 2005/0132498 | A1 | 6/2005 | Vrionis | |
| 2005/0177942 | A1 | 8/2005 | Finn | |
| 2005/0217030 | A1 | 10/2005 | Seigler | |
| 2006/0010608 | A1 | 1/2006 | DeFranks et al. | |
| 2006/0130235 | A1 | 6/2006 | Wilson | |
| 2006/0205319 | A1 | 9/2006 | Colvin | |
| 2006/0218726 | A1 | 10/2006 | Waters et al. | |
| 2009/0211024 | A1 | 8/2009 | Maloney et al. | |
| 2009/0313755 | A1 | 12/2009 | Vurrell, VI | |
| 2010/0107338 | A1 | 5/2010 | Waters et al. | |
| 2010/0154119 | A1 | 5/2010 | Shuttleworth | |
| 2010/0223726 | A1 | 9/2010 | Maloney | |
| 2010/0257654 | A1 | 10/2010 | Waters et al. | |
| 2010/0319122 | A1 | 12/2010 | Crumrine | |
| 2011/0041247 | A1 | 2/2011 | Moon | |
| 2011/0113552 | A1 | 5/2011 | Miller | |
| 2011/0220102 | A1 | 9/2011 | Waters et al. | |
| 2012/0005829 | A1 | 1/2012 | Waters et al. | |
| 2012/0005831 | A1 | 1/2012 | Waters et al. | |
| 2012/0005833 | A1 | 1/2012 | Waters et al. | |
| 2012/0009844 | A1 | 1/2012 | Waters et al. | |
| 2012/0030879 | A1 | 2/2012 | Waters et al. | |
| 2012/0180215 | A1 | 7/2012 | Waters et al. | |
| 2012/0180786 | A1 | 7/2012 | Waters et al. | |
| 2012/0241483 | A1 | 9/2012 | Waters et al. | |
| 2012/0278995 | A1 | 11/2012 | Kaplan et al. | |
| 2012/0284919 | A1 | 11/2012 | Davis | |
| 2012/0311792 | A1 | 12/2012 | Reeves et al. | |
| 2012/0317721 | A1 | 12/2012 | Dunne et al. | |
| 2013/0097784 | A1 | 4/2013 | Kaplan et al. | |
| 2013/0097785 | A1 | 4/2013 | Cicci | |
| 2013/0174315 | A1 | 7/2013 | Slank | |
| 2013/0283533 | A1 | 10/2013 | Bendickson | |
| 2013/0333112 | A1 | 12/2013 | Dunne et al. | |
| 2014/0096320 | A1 | 4/2014 | Wilson | |
| 2014/0096323 | A1 | 4/2014 | Alletto | |
| 2014/0157520 | A1 | 6/2014 | Cicci | |
| 2014/0189955 | A1 | 7/2014 | Alletto | |
| 2014/0196211 | A1 | 7/2014 | Kaplan et al. | |
| 2014/0283303 | A1 | 9/2014 | Rochlin | |
| 2014/0317850 | A1 | 10/2014 | Alletto | |
| 2014/0338402 | A1 | 11/2014 | Waters | |
| 2015/0335172 | A1 | 11/2015 | Waters | |
| 2015/0342370 | A1 | 12/2015 | Ashworth | |
| 2016/0174619 | A1* | 6/2016 | Waters | A41B 13/06 2/69.5 |

FOREIGN PATENT DOCUMENTS

| | | |
|---|---|---|
| WO | WO 99/56588 | 11/1999 |
| WO | WO 2004/056237 | 7/2004 |

OTHER PUBLICATIONS

"Baby Carrier Air" datasheet [online]. Babybjorn AB, Danderyd, Sweden, [retrieved on Nov. 3, 2006]. Retrieved from the Internet: <URL:http://www.babybjorn.com/TemplatesWeb/ProductDetails.asp?ItemId=2284>; 1 page.

"Cozy Crib Tent" magazine advertisement. Tots in Mind, Inc., Salem, NH; 1 page.

"High-Tech Toy Testing Equipment" datasheet [online]. U.S. Consumer Product Safety Commission [retrieved on Feb. 15, 2007]. Retrieved from the Internet: URL:http://www.cpsc.gov/cpscput/prerel/prhtm101/0155.html; 2 pgs.

"Virtual Child Model" datasheet [online]. Nemours, Jacksonville, FL, [retrieved on Feb. 15, 2007], Retrieved from the Internet: URL:http://nemours.org/internet?url=no/news/releases/2000/001212_unsafe_toys.html; 2 pgs.

Safe-N-Secure Crib Liner, 1998 Show Directory, The 29th Annual International Juvenile Products Show, Oct. 25-28, 1998 (Dallas, Texas).

Cribble™ Crib Slat Safety Wraps, The 1999 International Juvenile Products Show Directory Oct. 23-26, 1999 (Dallas, Texas).

Defendant's Prior Art Chart from Prior Art Statement in *BreathableBaby, LLC* v. *Crown Crafts, Inc.* and *Crown Crafts Infant Products, Inc.*, Civil Case No. 12-cv-00094 (PJS/TNL) before the United States District Court, District of Minnesota.

Plaintiff's Response to Prior Art Statement in *BreathableBaby, LLC* v. *Crown Crafts, Inc.* and *Crown Crafts Infant Products, Inc.*, Civil Case No. 12-cv-00094 (PJS/TNL) before the United States District Court, District of Minnesota.

* cited by examiner

Fig. 3A
300
Top-View
with Spacer Filler
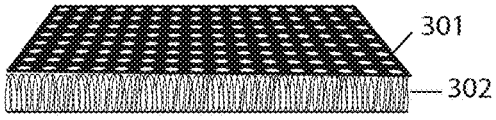
Fig. 3B
Cross-Section
Spacer Filler
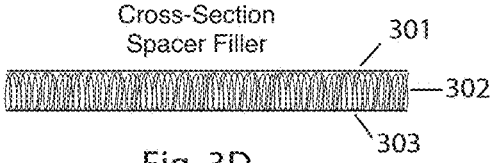
Fig. 3C
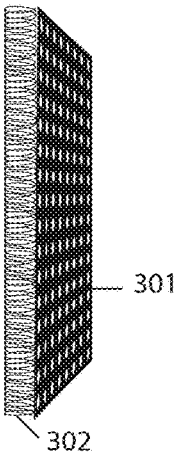
Cross-Section
with Front Spacer Mesh
Fig. 3D
Front-Side
with Spacer Mesh
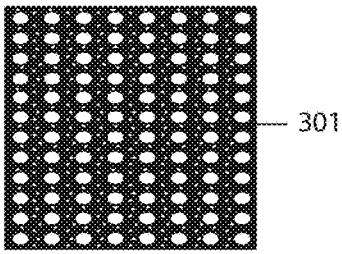
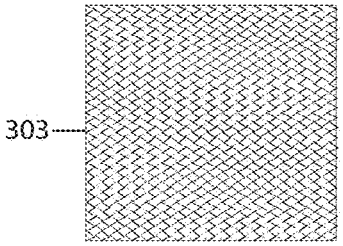
Back-Side
with Spacer Mesh
Fig. 3E
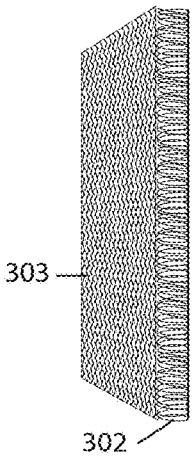
Cross-Section
with Back-Side Spacer Mesh
Fig. 3F

600

BREATHABLE GARMENT AND METHOD OF USE

CROSS-REFERENCE TO RELATED APPLICATIONS

This application is a continuation of U.S. application Ser. No. 12/755,547, filed Apr. 7, 2010, entitled "BREATHABLE GARMENT AND METHOD OF USE," which is a continuation-in-part of U.S. application Ser. No. 11/446,017, filed Jun. 2, 2006, now U.S. Pat. No. 7,523,513, which is a continuation of U.S. application Ser. No. 10/738,616, filed Dec. 16, 2003, now U.S. Pat. No. 7,055,192, both entitled "CRIB SHIELD SYSTEM AND OTHER BREATHABLE APPARATUS," which claims priority to U.S. Provisional Application No. 60/434,324, filed Dec. 17, 2002, the disclosures of which are incorporated by reference herein.

TECHNICAL FIELD

The present description relates to a garment and, more specifically, to a garment using breathable fabrics.

BACKGROUND

Infants usually breathe through their nasal passages. However, during crying or in the event their nasal passages are blocked, infants may breathe through their oral cavities. Mechanical resistance suffocation takes places when respiration is interrupted if these passages are both blocked externally by an object. When respiration is interrupted, $CO_2$ levels in the blood rise. The body's response to this elevation in $CO_2$ levels is to attempt more rigorous respiration. If the agent of suffocation is not removed, the incident may be fatal after two or three minutes. Further, breathing $CO_2$ or other dangerous gases may be a possible cause of sudden infant death syndrome (SIDS). Currently available garments do not adequately address mechanical resistance and buildup of CO2. Although the exact causes of SIDS remain unconfirmed, overheating is another suspected cause. Overheating may be caused by over-bundling, too much bedding material, or the wrong kinds of materials in an infant's bedding.

Additionally, some infants sweat heavily during the deepest part of their sleep cycles and can wake up wet from the accumulation of sweat. Babies spend more time in the deepest part of the sleep cycle than do children or adults, and are therefore more susceptible to waking up wet. Heat coupled with accumulated moisture can be a cause of heat rash and/or prickly heat. Currently available garments do not adequately address overheating and sweating. Therefore, improvements are desirable.

BRIEF SUMMARY

Overheating and sweating, as well as risk of suffocation, may be reduced by the use of a garment that includes a combination of fabrics that provide for wicking of moisture and for full-body-surrounding breathability, even on an infant's back side when the infant is laying on his or her back side. In one example, a garment includes a front side and a back side. The front side and back side are coupled to surround at least part of a person's body. The front side includes a mesh outer shell and a lightweight inner mesh liner, and the inner mesh liner includes a material that provides moisture wicking. The back side includes a breathable material that substantially maintains three-dimensional breathability when the person rests upon it. The garment provides breathability substantially surrounding said at least part of the person's body.

In another aspect, a method of using a garment is disclosed. The garment includes a breathable mesh outer shell and a lightweight inner mesh liner, the inner mesh liner including a material that provides moisture wicking, and a breathable material that substantially maintains three-dimensional breathability when a person rests upon it. A front side of the garment includes the mesh outer shell and lightweight inner mesh liner, and a back side of the garment includes the breathable material. The garment providing breathability substantially surrounding at least a part of a person's body. The method includes dressing the person in the garment and putting the person to rest on the person's back side.

In yet another aspect, a garment is disclosed that includes a front side and a back side, where the front side and back side are coupled to surround at least part of a person's body. The front side includes a mesh outer shell including means for providing breathable thermal comfort, and a lightweight inner mesh liner. The inner mesh liner includes means for wicking moisture. The back side includes means for providing three-dimensional breathability while supporting the weight of the person. The garment provides breathability substantially surrounding at least part of the person's body.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIGS. 3A-3F are illustrations of exemplary back side mesh shell material adapted according to one embodiment;

DETAILED DESCRIPTION

Figure 1:
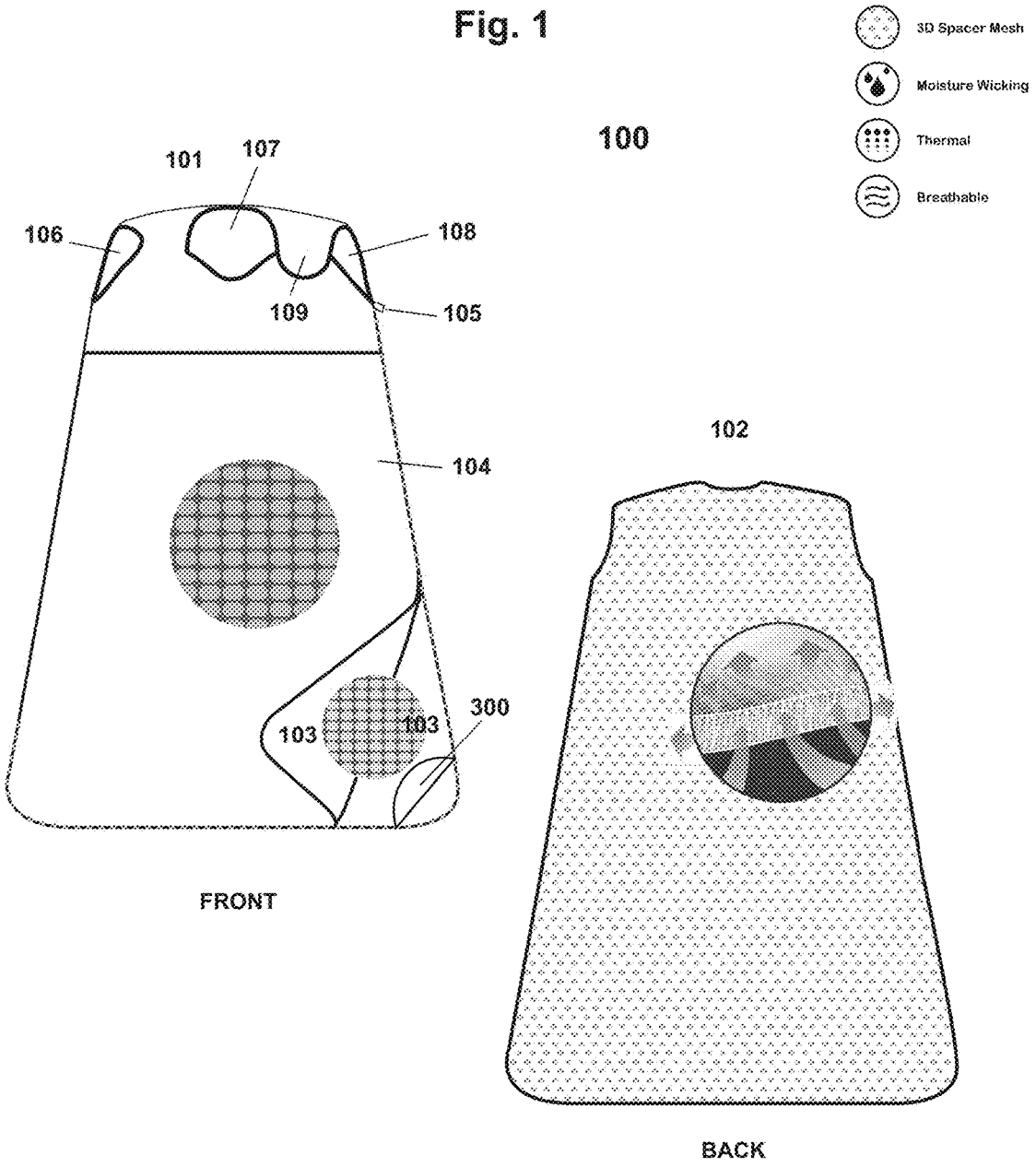
FIG. 1 is a front and back illustration of an exemplary garment adapted according to one embodiment.

FIG. 1 is a front and back illustration of an exemplary garment 100 adapted according to one embodiment. The front side 101 is shown partially folded to reveal an inner liner 103, which forms part of the front side 101 and the back side 102, and a mesh shell 300 described in more detail with respect to FIGS. 3A-5. The front and back sides 101, 102 are coupled together to form the garment 100. In this example, the front side 101 is coupled to the back side 102 at least partially using a zipper 105, though any technique for coupling fabric (e.g., hook and loop systems such as Velcro®, snaps, buttons, and the like) may be used in other embodiments. The front side 101 and the back side 102 are also coupled at portion 109 by, e.g., a hook and loop system, though any technique may be used.

Figure 2:
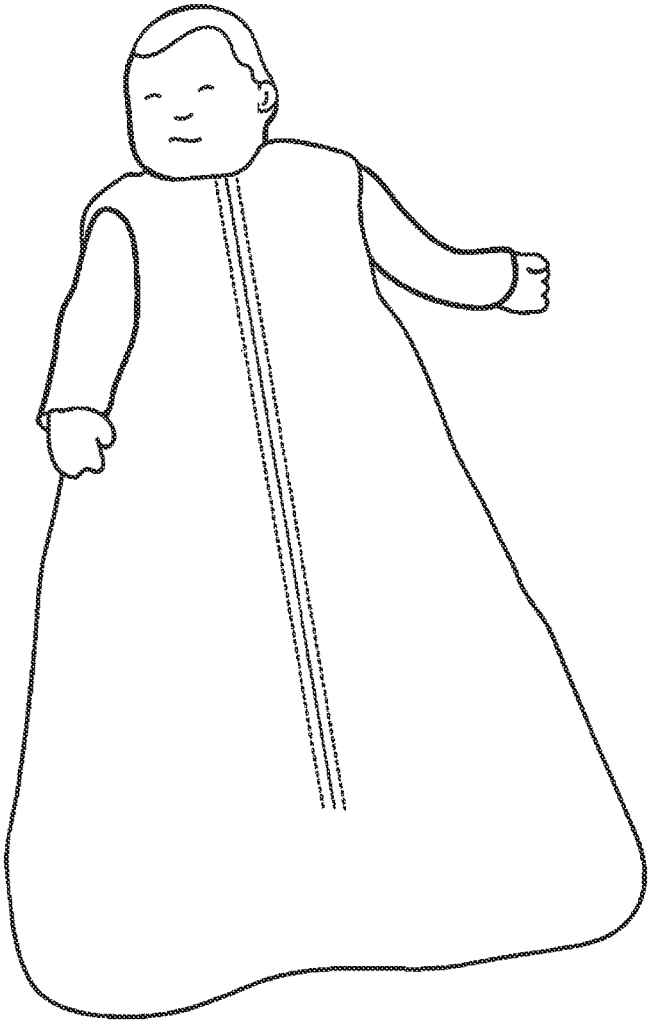
FIG. 2 is an example wearable blanket worn by a child.

Preferably, the garment 100 is a wearable blanket, allowing a caretaker to place a child therein by at least partially uncoupling the front side 101 and the back side 102, at least partially, placing a child in the garment 101 so that the child's arms and neck are exposed through holes 106, 107, 108, and re-coupling the front and back sides 101, 102 (i.e. zipping the zipper). The wearable blanket design covers the child's body from shoulders to feet and is enclosed at the feet, providing a warm (but not too warm) and safe sleep environment. An example wearable blanket worn by a child is shown in FIG. 2. It should be noted that the scope of embodiments is not limited to a wearable blanket (sometimes referred to as a "sleep sack"), as various embodiments may include any of a variety of garments or other devices. For instance, embodiments may include pants, shirts, footy pajamas, onesies, swaddles, wraps, slings, carriers, play toys, and even child and adult garments, and the like, that are made according to the principles described further herein.

Returning to FIG. 1, preferably the garment 100 includes at least three fabric layers. The front side 101 includes a plush mesh outer shell 104 and an inner liner 103. The plush mesh outer shell 104 has a mesh with holes that are about 0.5 mm in diameter. The plush mesh 104 is about 0.5 mm thick and provides breathability as well as thermal insulation. The inner liner 103 includes a lightweight mesh with holes that are about 0.5 mm in diameter. The inner liner 103 is also about 0.5 mm thick and provides breathability as well as moisture wicking.

The fabrics of the front side 101 and the back side 102 may include any of a variety of mesh-type materials that provide breathable functionality. Breathable functionality refers to the ability of the material to allow air to substantially move effectively therethrough. As used herein, when air is indicated as substantially moving effectively through a material, it is meant that the material includes openings (e.g., mesh openings, open-framework, spaces between elements thereof, or even those that may not be visually perceivable openings but still allow a breathable function to occur) that do not impede air movement to an extent that would prevent a human being from breathing through (e.g., when a human's respiratory openings are in direct contact with a material) such a material in order to prevent suffocation and further that such openings are too small to permit an infant to insert a finger or toe therethrough.

Preferably, the back side 102 of the garment 101 is made of a mesh shell 300, which is described in more detail with respect to FIGS. 3A-5. In this example, the spacer mesh shell is about 2 mm thick with holes that are about 1 mm in diameter. Additionally, back side 102 includes an inner liner the same as liner 103 on a mesh shell, where the mesh shell is shown in FIGS. 3A-5. The mesh shell 300 is configured to provide breathability even when a person lays upon it. In one aspect, the mesh shell 300 compresses under the weight of the baby but still maintains its shape enough that airflow is not substantially impeded. Thus, when the back side of a baby's garment includes the mesh shell 300 of FIG. 1, air can flow between the baby and whichever substrate the baby lays on (e.g., a mattress) by virtue of the breathable quality of the mesh shell 300. In the example of the garment 100, there is breathability substantially surrounding the baby's body, even the baby's back side when the baby is lying down on his or her back. Furthermore, the breathability exists despite the enclosed configuration of the wearable blanket of FIG. 1 because of the breathable properties of the fabric layers 300, 103, and 104.

Under the ASTM D1518 Thermal Transmittance of materials test, the thermal resistance, in a value referred to as TOG, is equal to 10 times the temperature difference (in ° C.) between two faces of a material when the flow of heat is equal to one Watt/$m^2$. The thermal transmittance is largely a function of (1) the thickness of a garment and (2) the amount of material in a garment. The three layers 300, 103, 104 of mesh fabric release excess body heat while keeping the body warm. By contrast, in conventional fabrics used for sleepwear, a body can overheat if over dressed and excess body heat cannot escape through the fabric walls. The TOG value for all three mesh fabrics 300, 103, 104 of this example is less than other non-breathable fabrics because of the ability to allow for relatively easy movement of air through the fabric, which will also influence the retention of heat and moisture. Embodiments presented herein provide a balance of both heat retention and airflow, which prevents overheating.

The ASTM E96 Water Vapor Transmission rate (MVTR) test is typically dominated by the amount of material and the thickness of a garment because such tests measure the rates of thermal and molecular diffusion through the materials. The three layers 300, 103, 104 of mesh fabric tested show that more moisture vapor evaporates out of the 2 mm mesh with light liner mesh of back side 102 than compared to other tested fabrics used in sleepwear. Excess body heat can escape through the open pores of the mesh fabrics and evaporate quickly, keeping the body dry and comfortable and preventing a wet, sweaty skin. The average absorption wicking rate in inches for the 2 mm mesh and inner liner mesh fabrics of the back side 102 together, after three washings, is 2.5 length and 2.5 width. The average absorption wicking rate in inches for the inner layer liner mesh alone is 6.0 length and 5.6 width. An average of water vapor transmission rate (WVTR) of 4870.7, 5617.8, 3037.1 for all three mesh fabrics used results in a very good natural moisture wicking property of the fabric.

The ASTM D737 Air Permeability test measures the degree to which a fabric permits the interchange of fluid such as air and water. The three layers 300, 103, 104 of mesh fabric tested, are very porous with holes that allow air to flow from the back side 102 and front side 101 of the fabrics. Because of the porosity of the fabrics used, garment 100 does not trap excess heat, thereby minimizing overheating and sweating. This is unlike other conventional fabrics used to keep the body warm, where the fabric does not release the excess heat and entraps the wetness, which can cause medical issues.

The Carbon Dioxide Dispersal Test is a study of $CO_2$ retention during simulated breathing cycles, where three layers 300, 103, 104 of mesh fabric exhibited the ability to disperse $CO_2$ more effectively than conventional blankets when the conventional blankets were positioned so gases could move through them. In addition, the three layers 300, 103, 104 of mesh fabric did not contribute significantly to the retention of $CO_2$ when such layers were positioned so that gases could pass through easily. Such findings indicate that the ability of the three layers 300, 103, 104 of mesh fabric to disperse $CO_2$ is a safety advantage that can limit the likelihood of $CO_2$ rebreathing for infants in comparison to the conventional blankets evaluated.

Fabrics that can be used include, but are not limited to cotton, silk, polyester, nylon, and the like. In fact, one embodiment is made of 100% polyester fabric, polyester being versatile enough to be manufactured into each of the layers described above. The examples above provide specific numbers for some qualities of the three layers 102, 103, 104. It should be noted that the scope of embodiments is not limited to any particular value for mesh size, thickness, thermal transmission, carbon dioxide dispersion, water vapor transmission, air permeability, and the like. Various embodiments include fabrics that provide breathability, even when placed over an infant's mouth and nose, but do not include holes in the mesh that are large enough to fit a finger or other appendage. In fact, any garment providing a breathable thermal outer shell on one side, an inner liner that wicks moisture, and a breathable other side is contemplated.

It will be recognized that the thickness of any of the materials may vary, as well as for other materials described herein. For example, more padding may create a softer more plush effect with slightly different breathability/ventilation properties, whereas less padding may create more breathability and buoyancy.

Additionally, any of the mesh-type materials herein may be configured as a breathable integrated mesh material in combination with one or more other material layers. For example, a mesh material may be used in combination with one or more layers of other material adjacent thereto. Such additional layers may be layers of cotton material, knit jersey material, and/or the like. Such additional material layers may provide additional benefits such as, for example, thermal properties with breathability.

FIGS. 3A-3F are illustrations of an exemplary back side mesh shell material 300, adapted according to one embodiment. The back side mesh shell material 300 can be used, for instance, in the back side 102 of FIG. 1. In the embodiment of FIG. 1, back side mesh shell material 300 is lined with an inner mesh material for wicking moisture, where the inner mesh is the same as or similar to inner liner 103. Such inner liner is not shown in FIGS. 3A-3F in order to give an unobstructed view of back side mesh shell material 300.

FIG. 3A shows a top view of the back side mesh shell material 300 and provides an illustration of two of the layers that make up the back side mesh shell material 300. The back side mesh shell material 300 looks like three separate layers in FIGS. 3A-3F, but it is really one unitary, knitted fabric. The back side mesh shell material 300 has a top mesh layer 301 and a spacer filler 302. The top mesh layer 301 is a single knit layer so that it is relatively thin. The top mesh layer 301 and the bottom mesh layer 303 (e.g., FIG. 3F) are coupled to the spacer filler 302 with a weaving technique using the fibers that are provided as part of the spacer filler 302, rather than, for example by adhesive. However, other embodiments may use any of a variety of techniques for constructing the back side mesh shell 300 material, including the use of adhesives.

The bottom mesh layer 303 is also a relatively thin, single-knit layer. The bottom mesh layer 303 has holes that are quite small in comparison to those of the top mesh layer. Like the top mesh layer 301 and the spacer filler 302, the bottom mesh layer 303 is breathable.

Figure 4:
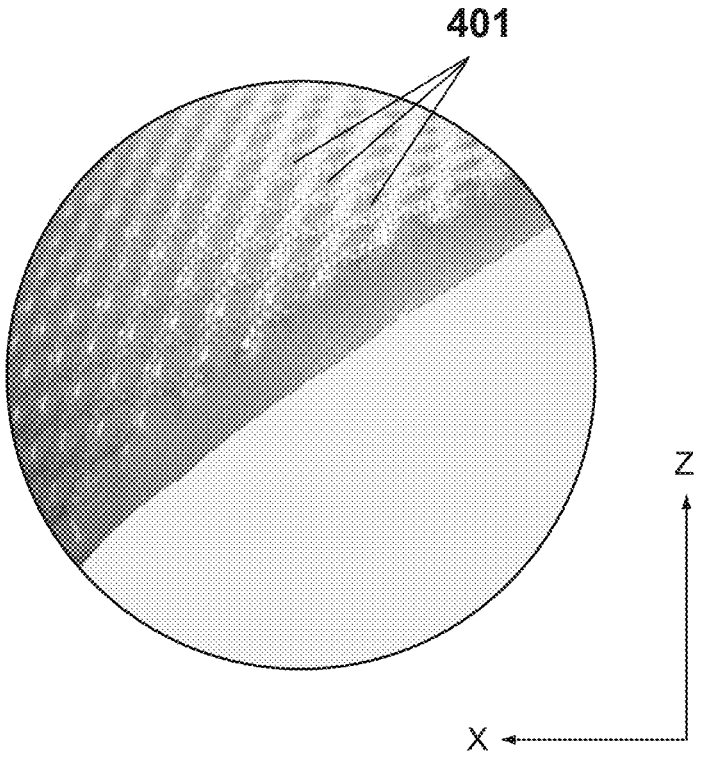
FIG. 4 is a top view illustration of the exemplary spacer filler according to one embodiment.
Figure 5:
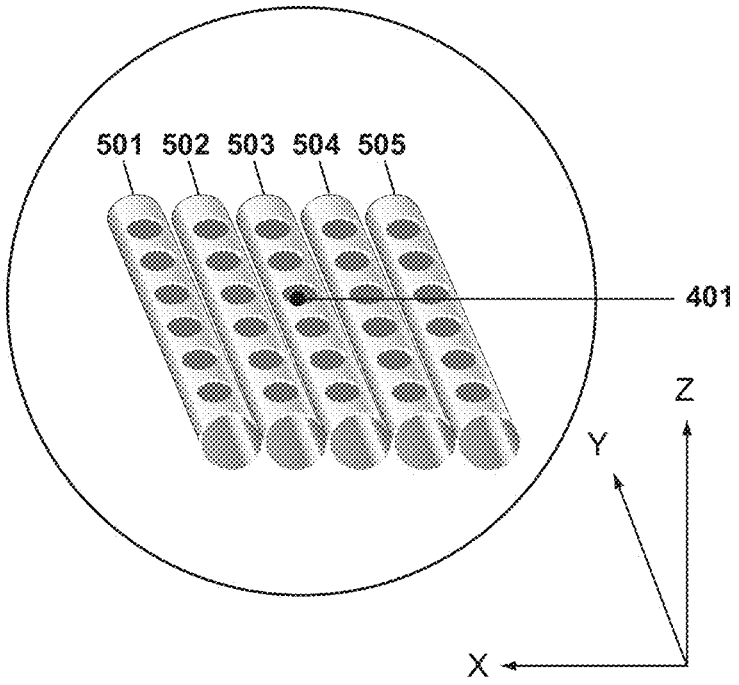
FIG. 5 is a close-up, conceptual illustration of a portion of the spacer filler shown in FIG. 4.

The material 300 includes several aspects that allow for good breathability. FIG. 4 is a top view illustration of the exemplary material 300 according to one embodiment. The material 300 includes a fabric sheet with a thickness of about 2 mm thick. The material 300 also has a multiplicity of holes, e.g., holes 401, which promote breathability. The holes are about 1 mm in diameter. The fabric of the material is three-dimensionally breathable. FIG. 5 is a close-up, conceptual illustration of a portion of the material 300. The fibers of the material of the spacer filler 302 are arranged so as to create air channels 501-505 in the x- and y-dimensions. The holes 401 allow air to flow in the z-dimension so that air can flow vertically and horizontally within the spacer filler 302. In effect, the fibers create thousands or millions of web-like channels through which air flows in three dimensions. The result is that the back side mesh shell material 300 has access to airflow even when it is laid on a non-breathable surface, such as a mattress, and even when it supports the weight of a person as the fibers do not completely compress.

While the example above provides various measurements, the scope of embodiments is not so limited. Any suitable material that is three-dimensionally breathable may be adapted for use in various embodiments.

Returning to FIG. 1, an infant may be placed on his or her back on top of the back side 102 of the garment when put to bed. The three materials 103, 104, and 300 (FIG. 3A) work together to provide breathability to the infant substantially surrounding the infant's body. Thus, air flows through the garment 100 to prevent overheating, and should part of the garment 100 be pressed up against the infant's face, the breathability of the garment 100 prevents suffocation and minimizes $CO_2$ rebreathing. The inner liner 103 wicks away moisture, which can then evaporate by virtue of the airflow.

Figure 6:
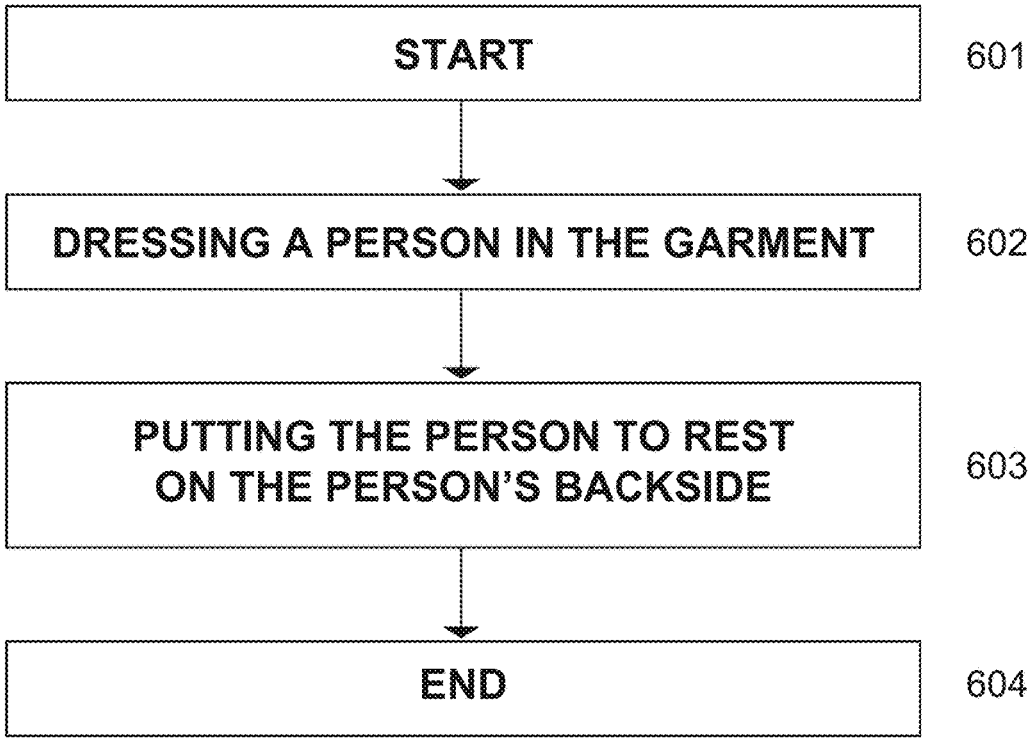
FIG. 6 is an illustration of an exemplary process adapted according to one embodiment.

FIG. 6 is an illustration of an exemplary process 600 adapted according to one embodiment. The process 600 may be performed, for example, by a caretaker of an infant or other person to be dressed in a garment, such as the garment shown in FIG. 1 or other breathable garment. The process 600 may also be performed by a child or adult dressing himself or herself.

The process 600 starts at block 601. At block 602, the person is dressed in the garment. In an embodiment wherein the garment is a wearable blanket, such as is shown in FIG. 1, block 602 may include placing the person in the garment, fastening the garment around the neck and shoulders, and coupling the front side and back side together to substantially enclose the person's body. Various embodiments, though, are not limited to use of a wearable blanket. Shirts, pants, and pajamas, blankets, swaddles, sleep sacks, wraps, slings, carriers, and other garments may be used in the process 600 as well.

In block 603, the person is put to rest on the person's back side so that the weight of the person is placed on the three-dimensionally breathable part of the garment. Once again, in an example wherein the garment is the wearable blanket of FIG. 1, the back side of the garment is three-dimensionally breathable, and the infant is placed to rest on his or her back, even if the infant is laid on a non-breathable surface. In embodiments including pants or a shirt, the person may lie down or sit down upon the three-dimensionally breathable part of the garment. The process 600 ends at block 604.

Embodiments may include one or more advantages over previous garments by addressing airflow and moisture wicking in a comprehensive manner. For instance, the embodiments described above provide for full breathability in the areas of the body covered by the garment. The enhanced breathability, including three-dimensional breathability on at least one portion, helps to dissipate heat. The enhanced breathability may also reduce accidental suffocation and $CO_2$ rebreathing. Having at least one inner liner that wicks moisture helps to minimize sweat accumulation. Furthermore, adding moisture wicking to a garment that has enhanced breathability provides synergy because the enhanced breathability should generally be expected to speed up evaporation, thereby making wicking more effective.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A garment comprising:

a front side; and a back side, in which the front side and back side are coupled to surround at least part of a person's body, the front side including a mesh outer shell and a lightweight inner mesh liner, the inner mesh liner including a material that provides moisture wicking, the back side including a breathable material that substantially maintains three-dimensional breathability when the person rests upon it, the garment providing breathability substantially surrounding said at least part of the person's body, wherein the breathable material includes a plurality of fibers oriented in a first direction, the plurality of fibers include holes allowing air to move in a second direction, the first direction and the second direction are perpendicular to each other.

2. The garment of claim 1 comprising a wearable blanket that is configured to enclose the person's body from feet to shoulders.

3. The garment of claim 1 in which the back side further comprises the inner mesh liner.

4. The garment of claim 1 in which the back side comprises:

a first layer of spacer mesh;

a second layer of spacer mesh; and a spacer filler between the first and second layers of spacer mesh.

5. The garment of claim 4 in which the back side lacks adhesive.

6. The garment of claim 4 in which a material of the spacer filler includes a plurality of vertical and horizontal air passageways.

7. The garment of claim 6 in which the plurality of vertical and horizontal air passageways collectively form an air-permeable web-like structure between the first and second layers of spacer mesh.

8. The garment of claim 4 in which the first and second layers of spacer mesh comprise single knit layers.

9. The garment of claim 1 including an item selected from the list consisting of:

a shirt;

pants;

pajamas;

adult clothing; and child clothing.

10. A method of using a garment, in which the garment includes a breathable mesh outer shell and a lightweight inner mesh liner, the inner mesh liner including a material that provides moisture wicking, and a breathable material that substantially maintains threedimensional breathability when a person rests upon it, wherein the breathable material includes a plurality of fibers oriented in a first direction, the plurality of fibers include holes allowing air to move in a second direction, the first direction and the second direction are perpendicular to each other, a front side of the garment including the mesh outer shell and lightweight inner mesh liner, a back side of the garment including the breathable material, the method comprising:

dressing the person in the garment; and putting the person to rest on the person's back side.

11. The method of claim 10 in which dressing the person comprises:

coupling the front side of the garment to the back side of the garment.

12. The method of claim 11 in which coupling the front side to the back side comprises:

substantially enclosing the person's body from shoulders to feet with the garment.

13. A garment comprising:

a front side; and a back side, in which the front side and back side are coupled to surround at least part of a person's body, the front side including:

a mesh outer shell including means for providing breathable thermal comfort; and a lightweight inner mesh liner, the inner mesh liner including means for wicking moisture;

the back side including:

a breathable fabric for providing three-dimensional breathability while supporting the weight of the person, the garment providing breathability substantially surrounding said at least part of the person's body, wherein the breathable fabric includes a plurality of fibers oriented in a first direction, the plurality of fibers include holes allowing air to move in a second direction, the first direction and the second direction are perpendicular to each other.

14. The garment of claim 13 comprising a wearable blanket that is configured to enclose the person's body from feet to shoulders.

15. The garment of claim 13 in which the back side further comprises the inner mesh liner.

16. The garment of claim 13 in which the breathable fabric for providing three-dimensional breathability comprises:

a first layer of spacer mesh;

a second layer of spacer mesh; and a spacer filler between the first and second layers of spacer mesh.

17. The garment of claim 16 in which a material of the spacer filler includes a plurality of vertical and horizontal air passageways.

18. The garment of claim 16 in which the plurality of vertical and horizontal air passageways collectively form an air-permeable web-like structure between the first and second layers of spacer mesh.

19. The garment of claim 16 in which the first and second layers of spacer mesh comprise single knit layers.

20. The garment of claim 13 including at least one of a shirt, pants, pajamas, a blanket, a swaddle, a sleep sack, a wearable blanket, a wrap, a sling, a carrier, adult clothing, and child clothing.

* * * * *